US009631431B2

(12) United States Patent
Chen et al.

(10) Patent No.: US 9,631,431 B2
(45) Date of Patent: Apr. 25, 2017

(54) WD SIDEWALL CORING TOOL

(75) Inventors: Li Chen, Guanghan (CN); Xiaobin Chen, Guanghan (CN); Pan Hu, Guanghan (CN); Juan Lv, Guanghan (CN)

(73) Assignee: DRILLING & PRODUCTION ENGINEERING TECHNOLOGY RESEARCH INSTITUTE OF CNPC CHUANGQING DRILLING EXPLORATION COMPANY, Guanghan, Sichuan (CN)

( * ) Notice: Subject to any disclaimer, the term of this patent is extended or adjusted under 35 U.S.C. 154(b) by 372 days.

(21) Appl. No.: 14/383,555

(22) PCT Filed: Apr. 17, 2012

(86) PCT No.: PCT/CN2012/000527

§ 371 (c)(1),
(2), (4) Date: Sep. 6, 2014

(87) PCT Pub. No.: WO2013/152457

PCT Pub. Date: Oct. 17, 2013

(65) Prior Publication Data

US 2015/0047909 A1 Feb. 19, 2015

(30) Foreign Application Priority Data

Apr. 11, 2012 (CN) ..... 2012 1 0104634

(51) Int. Cl.
*E21B 7/00* (2006.01)
*E21B 10/02* (2006.01)
(Continued)

(52) U.S. Cl.
CPC ..... *E21B 7/00* (2013.01); *E21B 10/02* (2013.01); *E21B 17/1078* (2013.01);
(Continued)

(58) Field of Classification Search
CPC . E21B 7/00; E21B 49/06; E21B 25/10; E21B 10/02
See application file for complete search history.

(56) References Cited

U.S. PATENT DOCUMENTS 2,516,421 A * 7/1950 Robertson ..... E21B 7/061 175/104
3,150,727 A * 9/1964 Garrison ..... E21B 49/06 166/193
(Continued)

FOREIGN PATENT DOCUMENTS

CN 2144707 Y * 10/1993
CN 2246710 Y * 2/1997

*Primary Examiner* — Elizabeth Gitlin

(57) ABSTRACT

A WD sidewall coring tool includes: an outer cylinder set (34); a retrieving mechanism (35); a drilling sealer mechanism (36); a power mechanism (37); and a coring mechanism (38); wherein the outer cylinder set (34) includes a stabilizer (1), a limiting connector (22), and a turning connector (23) connected in sequence; wherein the retrieving mechanism (35) includes a retrieving cylinder (39), a retrieving head set (40), and a steel rope (33); wherein the drilling sealer mechanism (36) includes a connecting rod (28), a universal joint (24), a plug sleeve (29), and a sealing plug (30); wherein the power mechanism (37) includes a flat thrust bearing (17), a screw stator (18), a screw rotor (19), a limiting piston (20), and a first spring (21); wherein the coring mechanism (38) includes a coring cylinder (25), a core grabber (26), and a coring bit (27).

11 Claims, 11 Drawing Sheets

(51) Int. Cl.

| | |
|---|---|
| ***E21B 17/10*** | (2006.01) |
| ***E21B 25/10*** | (2006.01) |
| ***E21B 33/12*** | (2006.01) |
| ***E21B 49/06*** | (2006.01) |

(52) U.S. Cl.
CPC ..... *E21B 25/10* (2013.01); *E21B 33/12* (2013.01); *E21B 49/06* (2013.01)

(56) References Cited

U.S. PATENT DOCUMENTS

| | | | | |
|---|---|---|---|---|
| 3,797,576 | A * | 3/1974 | Azalbert | E21B 4/00 166/169 |
| 7,530,407 | B2 * | 5/2009 | Tchakarov | E21B 49/06 175/20 |
| 2014/0166367 | A1 * | 6/2014 | Campbell | E21B 25/00 175/58 |

* cited by examiner

WD SIDEWALL CORING TOOL

CROSS REFERENCE OF RELATED APPLICATION

This is a U.S. National Stage under 35 U.S.C 371 of the International Application PCT/CN2012/000527, filed Apr. 17, 2012, which claims priority under 35 U.S.C. 119(a-d) to CN 201210104634.2, filed Apr. 11, 2012.

BACKGROUND OF THE PRESENT INVENTION

Field of Invention

The present invention relates to a technical field of oil and gas coring equipment manufacture, and more particularly to a WD (while-drilling) sidewall coring tool for oil drilling and coring, which is also suitable for coring a drilled stratum.

Description of Related Arts

In conventional technologies, such as Chinese patent CN 2144707, published Oct. 27, 1993, a rope retrieving type continuous coring tool is disclosed, wherein a conical cylinder device is connected to a bottom end of an inner cylinder of an inner cylinder assembly. A rotating assembly, a locking assembly forming a self-locking structure with an outer cylinder, and a retrieving device are connected to the inner cylinder from bottom to top. According to the present invention, a drill is only tripped once for continuous coring. With the continuous coring tool, drilling time and drilling cost are saved, labor intensity of workers is reduced, coring efficiency is improved, coring depth is increased, and exploration efficiency is improved. However, the conventional coring technologies, as represented by the above patent, still have the following disadvantages: coring is not able to be provided in drilled well sections, and stratum information of the drilled but not cored well section in a borehole is not able to be obtained.

For the above situation, Chinese patent CN2246710, published Feb. 5, 1997, discloses a drilling type sidewall coring tool, which belongs to a field of petroleum logging devices. The drilling type sidewall coring tool comprises a down part and a ground equipment. The down part comprises a mechanical node, an electronic node, and a cable connector. The ground equipment comprises a console, a boosting power, a switchboard, and a collecting ring. The coring tool adopts a double pushing structure, in such a manner that the coring tool firmly presses against a sidewall when coring. A motor is double-phase supplied, and no phase-shifting capacitor is needed, which improves reliability of the system. A convex body is detachably mounted on a shell of a hydraulic motor, wherein the hydraulic motor has a blade type inner structure, and a blade is supported by a supporting ring for closely pressing against an inner surface of a stator, so as to meet working requirements.

Although the conventional sidewall coring technologies, as represented by the above patents, are able to core a drilled well section, the drilling tool should be tripped before coring, and the conventional sidewall coring technologies are not able to provide WD sidewall coring. In addition, coring technique is not mature enough in the world. Therefore, cored volume is small, and quality is not good enough, which influences effectiveness of core analysis.

SUMMARY OF THE PRESENT INVENTION

For overcoming the above technical problems, an object of the present invention is to provide a WD sidewall coring tool for oil drilling and coring, wherein according to the present invention, a drill is not tripped before coring, so as to provide WD sidewall coring. The WD sidewall coring tool is also suitable for coring a drilled stratum, wherein a core with a large diameter is able to be obtained to ensure sufficient quality of the core.

Accordingly, in order to accomplish the above object, the present invention provides a WD sidewall coring tool, comprising:

an outer cylinder set;

a retrieving mechanism;

a drilling sealer mechanism;

a power mechanism; and a coring mechanism;

wherein the outer cylinder set comprises a stabilizer, a limiting connector, and a turning connector connected in sequence;

wherein the retrieving mechanism comprises a retrieving cylinder, a retrieving head set, and a steel rope, wherein the steel rope is connected to a radial through-hole of the retrieving cylinder, the retrieving cylinder is connected to the retrieving head set;

wherein the drilling sealer mechanism comprises a connecting rod, a universal joint, a plug sleeve, and a sealing plug, wherein the retrieving head set of the retrieving mechanism is connected to the connecting rod; the connecting rod, the universal joint, the plug sleeve, and the sealing plug are connected in sequence;

wherein the power mechanism comprises a flat thrust bearing, a screw stator, a screw rotor, a limiting piston, and a first spring, wherein the flat thrust bearing is axially mounted on the screw rotor, the screw rotor cooperates with the screw stator, a first end of the first spring is mounted on the limiting piston, a second end of the first spring cooperates with the limiting connector; and wherein the coring mechanism comprises a coring cylinder, a core grabber, and a coring bit, wherein the core grabber cooperates with an inner conical surface of the coring bit, the coring cylinder is connected to the coring bit.

Preferably, during overall drilling, an inner structure of the WD sidewall coring tool is: a bottom end of the retrieving head set is connected to the connecting rod through a screw thread, a bottom end of the connecting rod is connected to the plug sleeve through a screw thread, a bottom end of the plug sleeve is connected to the sealing plug through a screw thread; during overall drilling, the inner structure is placed in an inner cylinder set, the sealing plug blocks a coring window of the turning connector.

Preferably, during coring, an inner structure of the WD sidewall coring tool is: a bottom end of the steel rope is connected to the retrieving head set, a bottom end of the retrieving head set is connected to the power mechanism through a screw thread, a bottom end of the power mechanism is connected to the universal joint through a flange bolt, a bottom end of the universal joint is connected to the coring mechanism through a flange bolt; during coring, the inner structure is placed in an inner cylinder set.

Preferably, the outer cylinder set is pre-installed between a drill collar and an overall drilling bit; a top-to-bottom connection relationship thereof is: a bottom end of the drill collar is connected to the stabilizer through a screw thread, a bottom end of the stabilizer is connected to the limiting connector through a screw thread, a bottom end of the limiting connector is connected to the turning connector through a screw thread, a bottom end of the turning connector is connected to the overall drilling bit through a screw thread.

Preferably, the retrieving cylinder comprises a separating cylinder and a hook, the hook is loaded into the separating cylinder through a spring.

Preferably, the retrieving head set comprises a retrieving spear head, a second spring, a spring holder, a retrieving spear holder, a first elastic cylindrical pin, a second elastic cylindrical pin, a top sliding bush, a tension spring, two spring fastening calipers, a retrieving tube, a third elastic cylindrical pin, a cylindrical pin, a spring fastening holder, a spring fastening frame, and a fourth elastic cylindrical pin; a connection relationship of the retrieving head set is: firstly, the second spring is placed in the spring holder for being loaded into the retrieving spear head together with the spring holder, the retrieving spear head is connected to the retrieving spear holder through the first elastic cylindrical pin, the top sliding bush is connected to the retrieving spear holder through the second elastic cylindrical pin; secondly, the spring fastening holder is connected to the spring fastening frame through the cylindrical pin, the two spring fastening calipers are connected to the spring fastening frame through the third elastic cylindrical pin, the two spring fastening calipers are respectively connected to two ends of the tension spring, the retrieving tube is connected to the spring fastening frame through the fourth elastic cylindrical pin; and finally, a top end of the retrieving tube is connected to a bottom end of the top sliding bush through a screw thread, the steel rope hangs on the separating cylinder.

Preferably, a connection relationship of the retrieving mechanism is: a bottom end of the steel rope passes through the radial through-hole of the retrieving cylinder and is fastened, the hook at a bottom end of the retrieving cylinder opens or closes for being connected to or separated from the retrieving spear head on the retrieving head set.

Preferably, a connection relationship of the drilling sealer mechanism is: firstly, the spring fastening frame on the retrieving head set is connected to the connecting rod through a screw thread; secondly, the connecting rod is connected to the universal joint through a flange bolt, the universal joint is connected to the plug sleeve through a flange bolt; and finally the plug sleeve is connected to the sealing plug through a screw thread.

Preferably, a connection relationship of the power mechanism is: firstly, the flat thrust bearing is placed at a top platform of the screw rotor and is pushed forwards for being axially mounted, and the screw rotor is placed in the screw stator; secondly, the first end of the first spring is welded on the limiting piston; and finally, the second end of the first spring is placed at an inner platform surface of the limiting connector by gravity.

Preferably, a connection relationship of the coring mechanism is: the core grabber cooperates with the inner conical surface of the coring bit, and then the coring cylinder is connected to the coring bit through a screw thread.

Compared with the conventional technologies, advantages of the present invention are as follows.

1) Compared with Chinese patent CN 2144707, the WD sidewall coring tool comprising the outer cylinder set, the retrieving mechanism, the drilling sealer mechanism, the power mechanism and the coring mechanism is able to core a drilled well, and is able to obtain stratum information of a drilled but not cored well section in a borehole. Compared with the conventional technologies as represented by Chinese patent CN2246710, a drill is not tripped before coring, which enables WD sidewall coring and a strong instant coring function. In addition, the WD sidewall coring tool has a reasonable structure design, and is able to be disassembled and assembled conveniently. Compared with the conventional coring tool as represented by Chinese patent CN2144707, the WD sidewall coring tool is able to core a drilled but not cored well section. Coring with the WD sidewall coring tool is more targeted, reduces pollution, saves time, improves efficiency, and is able to obtain a core with a large diameter and a sufficient length, so as to ensure core quality. WD sidewall coring technologies are very important for coring at stratums with low yields and a drilled stratum in the borehole, and provide an effective method for obtaining parameters such as stratum information of the stratums with low yields and the drilled stratum in the borehole.

2) According to the present invention, the inner structures during overall drilling and coring form a preferred embodiment of the WD sidewall coring tool, and improve a working efficiency.

3) According to the present invention, specific structures and connections of the outer cylinder set, the retrieving mechanism, the drilling sealer mechanism, the power mechanism and the coring mechanism provide a best effect of the present invention, which means that WD sidewall coring is provided while a core with a large diameter and a sufficient length is obtained with ensured core quality.

These and other objectives, features, and advantages of the present invention will become apparent from the following detailed description, the accompanying drawings, and the appended claims.

BRIEF DESCRIPTION OF THE DRAWINGS

Referring to drawings and preferred embodiments, the present invention is further illustrated.

FIG. 1-2 is a sectional view of the WD sidewall coring tool during overall drilling according to the preferred embodiments of the present invention.

FIG. 2 is a sectional view of an outer cylinder set according to the preferred embodiments of the present invention.

FIG. 3-1 is a sketch view of an inner structure of the coring tool during coring according to the preferred embodiments of the present invention.

FIG. 3-2 is a sketch view of the inner structure of the coring tool during overall drilling according to the preferred embodiments of the present invention.

Figure 1:
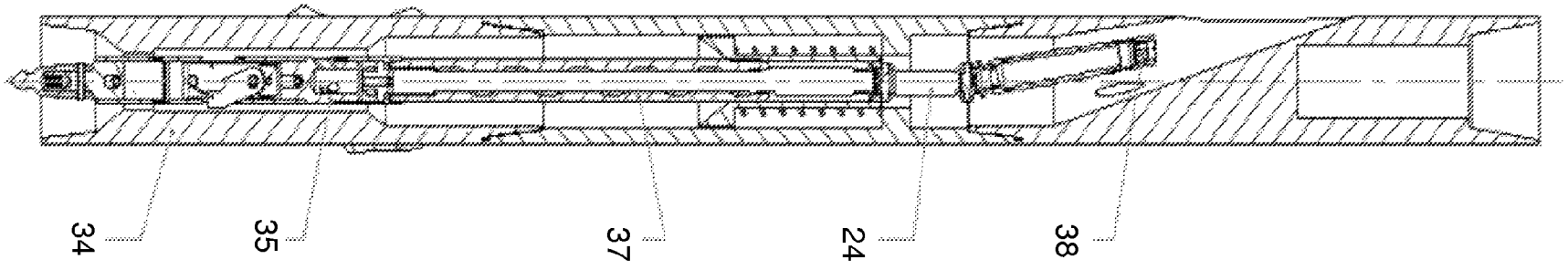
FIG. 1-1 is a sectional view of a WD sidewall coring tool during coring according to preferred embodiments of the present invention.

Reference numbers of elements: 1—stabilizer, 2—retrieving spear head, 3—second spring, 4—spring holder, 5—retrieving spear holder, 6—first elastic cylindrical pin, 7—second elastic cylindrical pin, 8—top sliding bush, 9—tension spring, 10—spring fastening caliper, 11—retrieving tube, 12—third elastic cylindrical pin, 13—cylindrical pin,

14—spring fastening holder, 15—spring fastening frame, 16—fourth elastic cylindrical pin, 17—flat thrust bearing, 18—screw stator, 19—screw rotor, 20—limiting piston, 21—first spring, 22—liming connector, 23—turning connector, 24—universal joint, 25—coring cylinder, 26—core grabber, 27—coring bit, 28—connecting rod, 29—plug sleeve, 30—sealing plug, 31—separating cylinder, 32—hook, 33—steel rope, 34—outer cylinder set, 35—retrieving mechanism, 36—drilling sealer mechanism, 37—power mechanism, 38—coring mechanism, 39—retrieving cylinder, 40—retrieving head set

DETAILED DESCRIPTION OF THE PREFERRED EMBODIMENT

Preferred Embodiment 1

A WD sidewall coring tool comprises:

an outer cylinder set 34;

a retrieving mechanism 35;

a drilling sealer mechanism 36;

a power mechanism 37; and a coring mechanism 38;

wherein the outer cylinder set 34 comprises a stabilizer 1, a limiting connector 22, and a turning connector 23 connected in sequence;

wherein the retrieving mechanism 35 comprises a retrieving cylinder 39, a retrieving head set 40, and a steel rope 33, wherein the steel rope 33 is connected to a radial through-hole of the retrieving cylinder 39, the retrieving cylinder 39 is connected to the retrieving head set 40;

wherein the drilling sealer mechanism 36 comprises a connecting rod 28, a universal joint 24, a plug sleeve 29, and a sealing plug 30, wherein the retrieving head set 40 is connected to the connecting rod 28; the connecting rod 28, the universal joint 24, the plug sleeve 29, and the sealing plug 30 are connected in sequence;

wherein the power mechanism 37 comprises a flat thrust bearing 17, a screw stator 18, a screw rotor 19, a limiting piston 20, and a first spring 21, wherein the flat thrust bearing 17 is axially mounted on the screw rotor 19, the screw rotor 19 cooperates with the screw stator 18, a first end of the first spring 21 is mounted on the limiting piston 20, a second end of the first spring 21 cooperates with the limiting connector 22;

wherein the coring mechanism 38 comprises a coring cylinder 25, a core grabber 26, and a coring bit 27, wherein the core grabber 26 cooperates with an inner conical surface of the coring bit 27, the coring cylinder 25 is connected to the coring bit 27.

In the preferred embodiment 1, the outer cylinder set 34, the retrieving mechanism 35, the drilling sealer mechanism 36, the power mechanism 37, and the coring mechanism 38 relate to conventional technologies and are commercially available. Focus is put on a connection relationship thereof.

The outer cylinder set 34 is pre-installed between a drill collar and an overall drilling bit; a top-to-bottom connection relationship thereof is: a bottom end of the drill collar is connected to the stabilizer 1 through a screw thread, a bottom end of the stabilizer 1 is connected to the limiting connector 22 through a screw thread, a bottom end of the limiting connector 22 is connected to the turning connector 23 through a screw thread, a bottom end of the turning connector 23 is connected to the overall drilling bit through a screw thread.

During overall drilling, an inner structure of the WD sidewall coring tool is: a bottom end of the retrieving head set 40 is connected to the connecting rod 28 through a screw thread, a bottom end of the connecting rod 28 is connected to the plug sleeve 29 through a screw thread, a bottom end of the plug sleeve 29 is connected to the sealing plug 30 through a screw thread; during overall drilling, the inner structure is placed in an inner cylinder set, the sealing plug 30 blocks a coring window of the turning connector 23.

During coring, an inner structure of the WD sidewall coring tool is: a bottom end of the steel rope 33 is connected to the retrieving head set 40, a bottom end of the retrieving head set 40 is connected to the power mechanism 37 through a screw thread, a bottom end of the power mechanism 37 is connected to the universal joint 24 through a flange bolt, a bottom end of the universal joint 24 is connected to the coring mechanism 38 through a flange bolt; during coring, the inner structure is placed in the inner cylinder set.

Before overall drilling, the retrieving head set 40 and the drilling sealer mechanism 36 are put into the outer cylinder set 34 by the retrieving cylinder 39. The sealing plug 30 blocks the coring window of the turning connector 23. Drilling fluid circulates through the turning connector 23 for providing normal overall drilling. For coring, the overall drilling is stopped, as well as a pump; the retrieving head set 40 and the drilling sealer mechanism 36 are pulled out by the steel rope 33 and the retrieving cylinder 39; then the inner structure for coring is placed in the outer cylinder 34 by the steel rope 33 and the retrieving cylinder 39; when the pump is started, because of the limiting piston 20, the drilling fluid is only able to pass through a hydraulic screw motor for generating a coring torque by driving the hydraulic screw motor to rotate. Meanwhile, because a combination of a pressure and a friction force applied on the power mechanism 37 by the drilling fluid is larger than a spring force and a drilling fluid buoyancy at the limiting piston 20, the coring mechanism 38 is pressed downwards by the drilling fluid. The coring bit 27 extends out through the coring window for rotary coring and drilling. After coring, the retrieving mechanism 35 is put down and the core obtained is lifted. For overall drilling after pulling out the coring mechanism 38, the retrieving head set 40 and the drilling sealer mechanism 36 are driven downwards by the retrieving cylinder 39, and the sealing plug 30 blocks the coring window of the turning connector 23, for overall drilling.

Preferred Embodiment 2

Figures 1, 2:
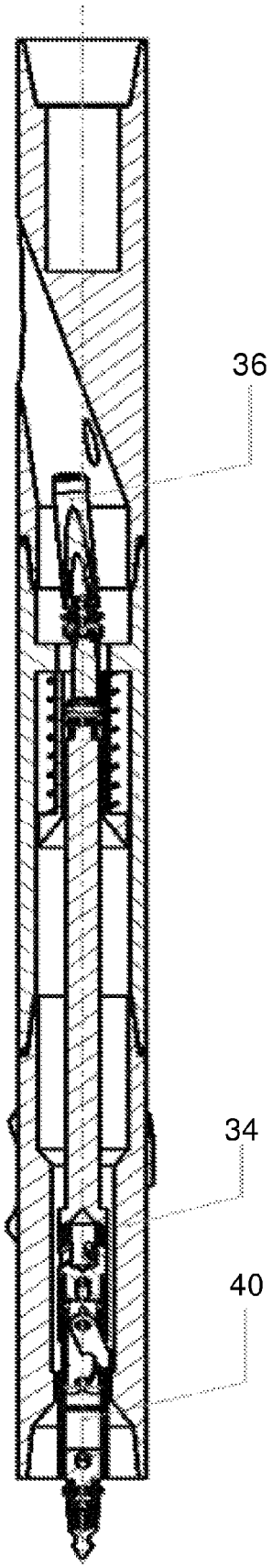
Figure 2:
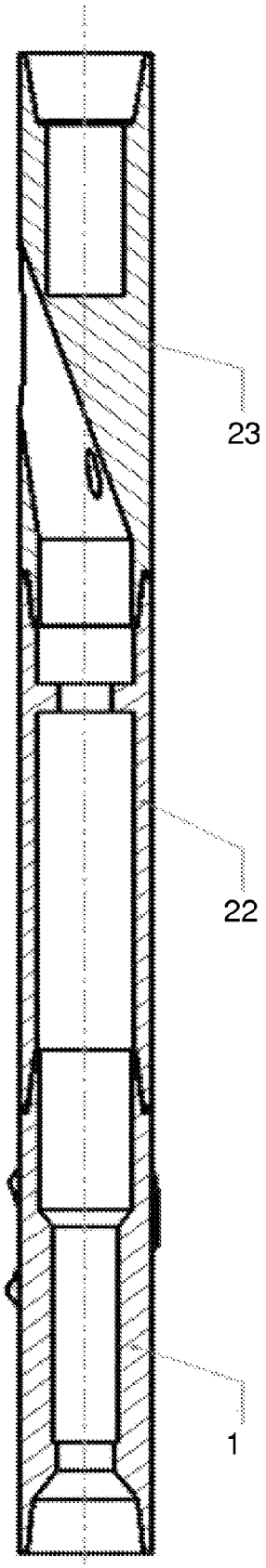
Figures 1, 3:
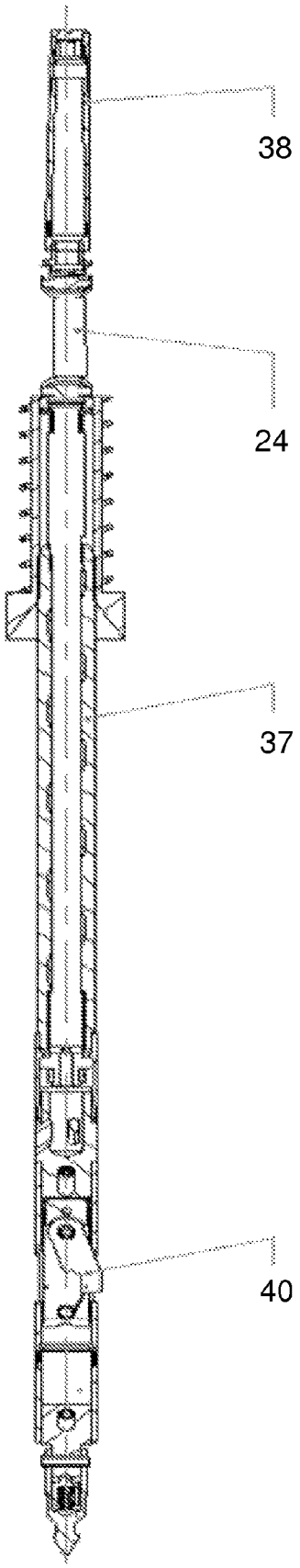
Figures 2, 3:
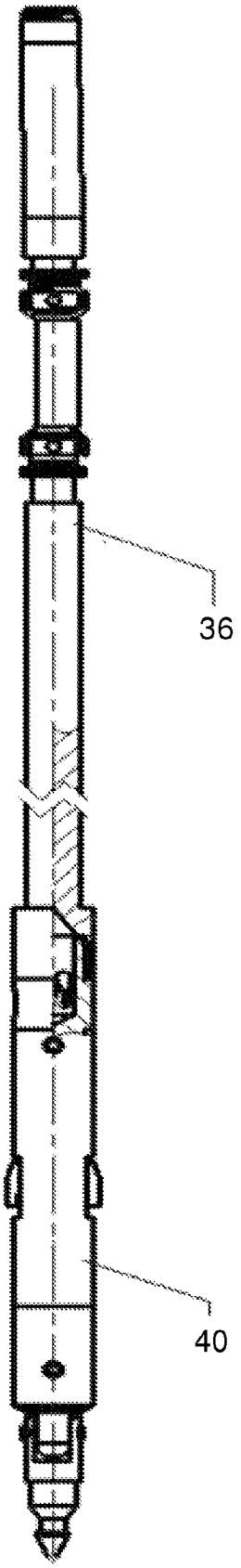
Figure 4:
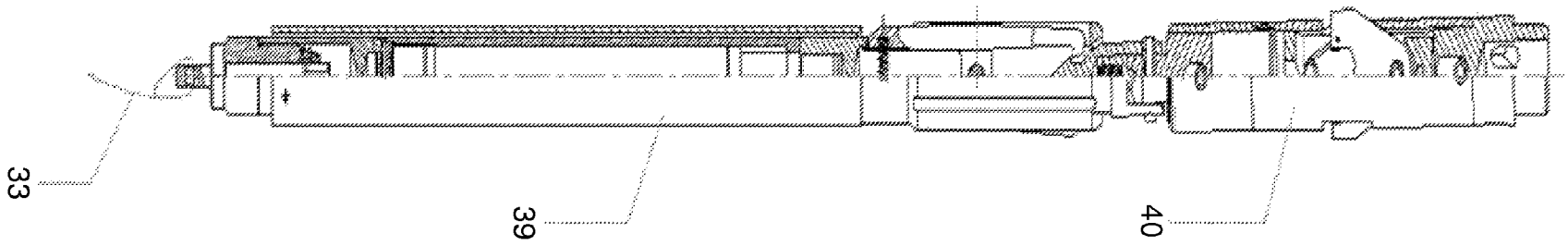
FIG. 4 is a sketch view of a retrieving mechanism according to the preferred embodiments of the present invention.
Figure 5:
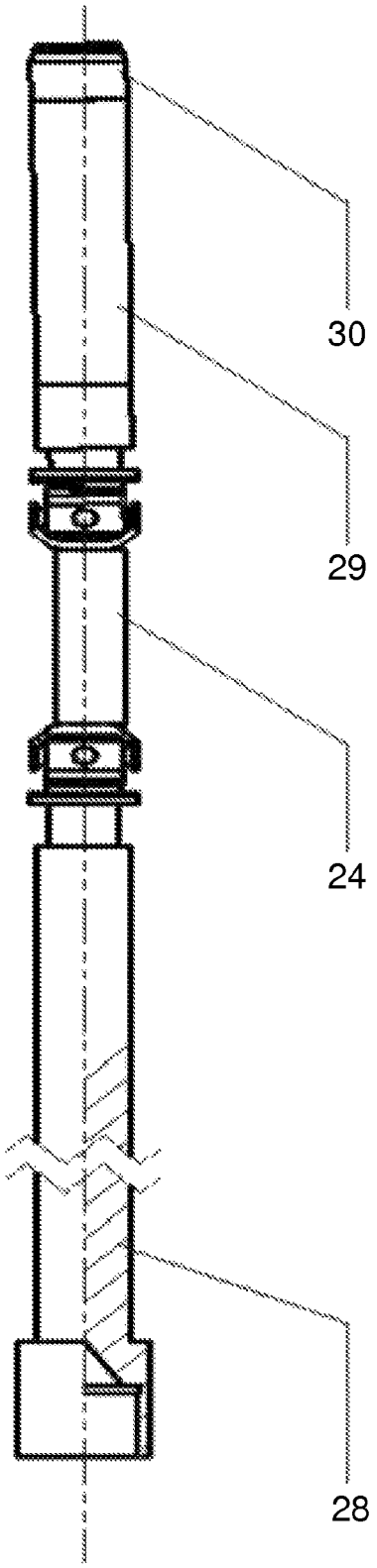
FIG. 5 is a sketch view of a drilling sealer mechanism according to the preferred embodiments of the present invention.
Figure 6:
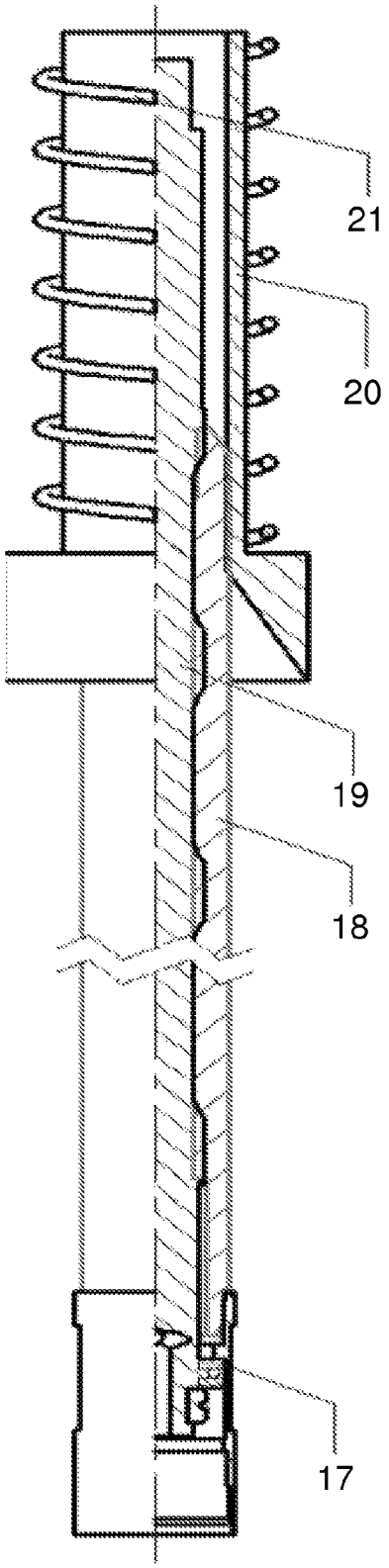
FIG. 6 is a sketch view of a power mechanism according to the preferred embodiments of the present invention.
Figure 7:
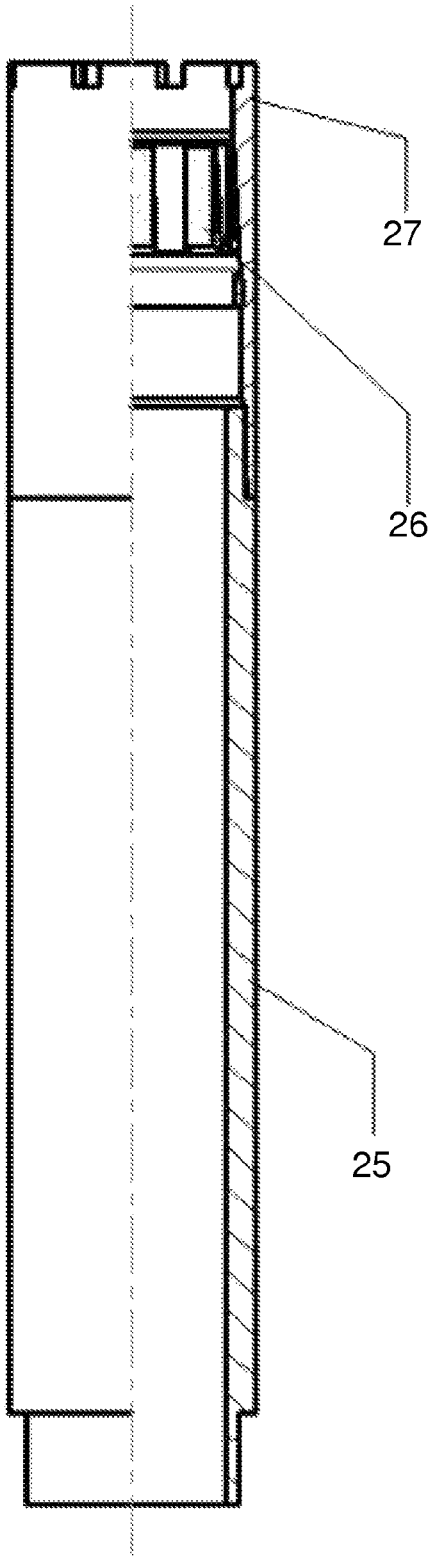
FIG. 7 is a sketch view of a coring mechanism according to the preferred embodiments of the present invention.
Figure 8:
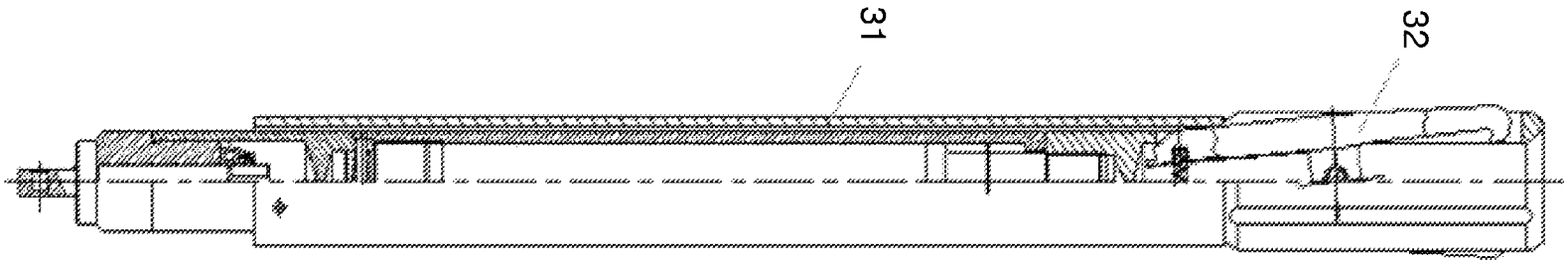
FIG. 8 is a sketch view of a retrieving cylinder according to the preferred embodiments of the present invention.
Figure 9:
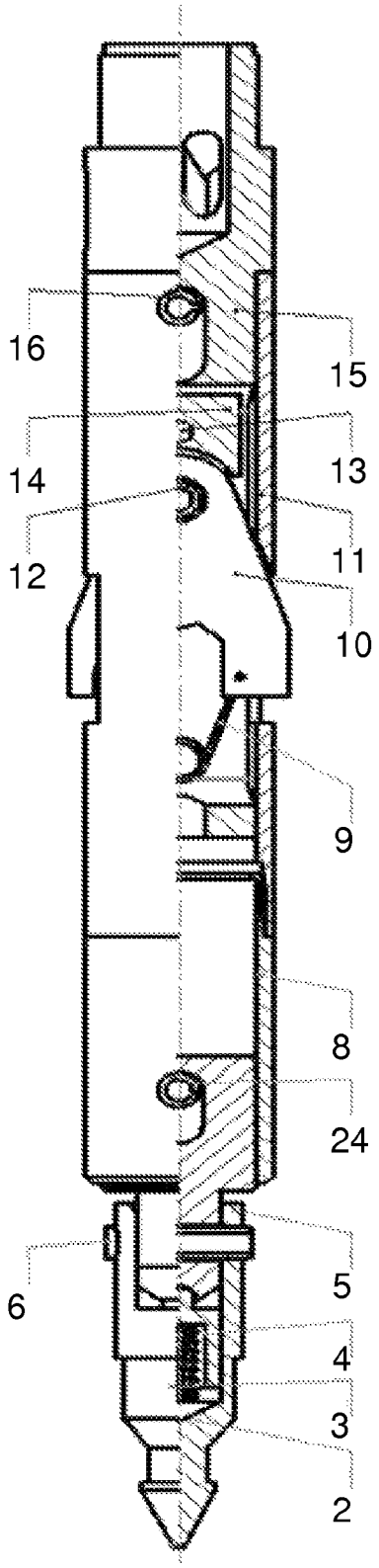
FIG. 9 is a sketch view of a retrieving head set according to the preferred embodiments of the present invention.

As a best embodiment of the present invention, referring to FIG. 1-FIG. 9, the preferred embodiment 2 is based on the preferred embodiment 1, wherein the retrieving cylinder 39 comprises a separating cylinder 31 and a hook 32, the hook 32 is loaded into the separating cylinder 31 through a spring. The retrieving head set 40 comprises a retrieving spear head 2, a second spring 3, a spring holder 4, a retrieving spear holder 5, a first elastic cylindrical pin 6, a second elastic cylindrical pin 7, a top sliding bush 8, a tension spring 9, two spring fastening calipers 10, a retrieving tube 11, a third elastic cylindrical pin 12, a cylindrical pin 13, a spring fastening holder 14, a spring fastening frame 15, and a fourth elastic cylindrical pin 16; a connection relationship of the retrieving head set 40 is: firstly, the second spring 3 is placed in the spring holder 4 for being loaded into the retrieving spear head together with the spring holder 4, the retrieving spear head 2 is connected to the retrieving spear holder 5 through the first elastic cylindrical pin 6, the top sliding bush 8 is connected to the retrieving spear holder through the second elastic cylindrical pin 7; secondly, the spring fastening holder 14 is connected to the spring fastening frame 15 through the cylindrical pin 13, the two spring fastening calipers 10 are connected to the spring fastening frame 15 through the third elastic cylindrical pin 12, the two spring fastening calipers 10 are respectively connected to two ends of the tension spring 9, the retrieving tube 11 is connecting to the spring fastening frame 15 through the fourth elastic cylindrical pin 16, and a top end of the retrieving tube 11 is connected to a bottom end of the top sliding bush 8 through a screw thread, the steel rope 33 is hang on the separating cylinder 31. A connection relationship of the retrieving mechanism 35 is: a bottom end of the steel rope 33 passes through the radial through-hole of the retrieving cylinder 39 and is fastened, the hook 32 at a bottom end of the retrieving cylinder 39 opens or closes for being connected to or separated from the retrieving spear head 2 on the retrieving head set 40. A connection relationship of the drilling sealer mechanism 36 is: firstly, the spring fastening frame 15 on the retrieving head set 40 is connected to the connecting rod 28 through a screw thread; secondly, the connecting rod 28 is connected to the universal joint 24 through a flange bolt, the universal joint 24 is connected to the plug sleeve 29 through a flange bolt, and the plug sleeve 29 is connected to the sealing plug 30 through a screw thread. A connection relationship of the power mechanism 37 is: firstly, the flat thrust bearing 17 is placed at a top platform of the screw rotor 19 and is pushed forwards for being axially mounted, and the screw rotor 19 is placed in the screw stator 18; secondly, the first end of the first spring 21 is welded on the limiting piston 20, the second end of the first spring 21 is placed at an inner platform surface of the limiting connector 22 by gravity. A connection relationship of the coring mechanism is: the core grabber 26 cooperates with the inner conical surface of the coring bit 27, the coring cylinder 25 is connected to the coring bit 27 through a screw thread.

As recited, in the preferred embodiment 2, the outer cylinder set 34, the retrieving mechanism 35, the drilling sealer mechanism 36, the power mechanism 37, and the coring mechanism 38 all have specific connection relationships, which forms the best embodiment of the present invention and provide best effects: WD sidewall coring is provided while a core with a large diameter and a sufficient length is obtained with ensured core quality.

Operation of the WD sidewall coring tool is as follows. The outer cylinder set 34 is pre-installed between the drill collar and the overall drilling bit. For overall drilling, the retrieving head set 40 and the drilling sealer mechanism 36 are put into the outer cylinder set 34 by the steel rope 33 and the retrieving cylinder 39. The sealing plug 30 blocks the coring window of the turning connector 23. Drilling fluid circulates through the turning connector 23 for providing normal overall drilling. For coring, the overall drilling is stopped, as well as a pump. The drilling sealer mechanism 36 is pulled out by the steel rope 33 and the retrieving mechanism 35. Then the inner structure for coring is placed in the outer cylinder 34 by the steel rope 33 and the retrieving cylinder 39. Then the pump is started, and a hydraulic screw motor generates a rotary power for drilling. Meanwhile, the coring mechanism 38 is pressed downwards by the drilling fluid. The coring bit 27 extends out through the coring window for rotary coring and drilling. Finally, the core obtained is lifted by the retrieving mechanism 35 for finishing coring.

Preferred Embodiment 3

The preferred embodiment 3 is a detailed example of the present invention.

Referring to FIG. 1-FIG. 9, the present invention is further illustrated.

The present invention provides a WD sidewall coring tool comprising:

an outer cylinder set 34;

a retrieving mechanism 35;

a drilling sealer mechanism 36;

a power mechanism 37; and a coring mechanism 38.

The outer cylinder set 34 is pre-installed between a drill collar and an overall drilling bit; a top-to-bottom connection relationship thereof is: a bottom end of the drill collar is connected to the stabilizer 1 through a screw thread, a bottom end of the stabilizer 1 is connected to the limiting connector 22 through a screw thread, a bottom end of the limiting connector 22 is connected to the turning connector 23 through a screw thread, a bottom end of the turning connector 23 is connected to the overall drilling bit through a screw thread.

During overall drilling, an inner structure of the WD sidewall coring tool is: a bottom end of the retrieving head set 40 is connected to the connecting rod 28 through a screw thread, a bottom end of the connecting rod 28 is connected to the plug sleeve 29 through a screw thread, a bottom end of the plug sleeve 29 is connected to the sealing plug 30 through a screw thread.

During overall drilling, the inner structure is placed in an inner cylinder set, in such a manner that the sealing plug 30 blocks a coring window of the turning connector 23.

During coring, the inner structure of the WD sidewall coring tool is: a bottom end of the steel rope 33 is connected to the retrieving head set 40, a bottom end of the retrieving head set 40 is connected to the power mechanism 37 through a screw thread, a bottom end of the power mechanism 37 is connected to the universal joint 24 through a flange bolt, a bottom end of the universal joint 24 is connected to the coring mechanism 38 through a flange bolt.

During coring, the inner structure is placed in the inner cylinder set.

Connection of the mechanisms is as follows.

The outer cylinder set 34 comprises a stabilizer 1, a limiting connector 22, and a turning connector 23, wherein the stabilizer 1, the limiting connector 22, and the turning connector 23 are connected in sequence through inner and outer screw threads.

The drilling sealer mechanism 36 comprises a connecting rod 28, a universal joint 24, a plug sleeve 29, and a sealing plug 30, wherein a connection relationship of the drilling sealer mechanism 36 is: firstly, the spring fastening frame 15 on the retrieving head set 40 is connected to the connecting rod 28 through a screw thread; secondly, the connecting rod 28 is connected to the universal joint 24 through a flange bolt, the universal joint 24 is connected to the plug sleeve 29 through a flange bolt; and finally, the plug sleeve 29 is connected to the sealing plug 30 through a screw thread.

The retrieving mechanism 35 comprises a retrieving cylinder 39, a retrieving head set 40, and a steel rope 33, wherein the retrieving cylinder 39 comprises a separating cylinder 31 and a hook 32; the retrieving head set 40 comprises a retrieving spear head 2, a second spring 3, a spring holder 4, a retrieving spear holder 5, a first elastic cylindrical pin 6, a second elastic cylindrical pin 7, a top sliding bush 8, a tension spring 9, two spring fastening calipers 10, a retrieving tube 11, a third elastic cylindrical pin 12, a cylindrical pin 13, a spring fastening holder 14, a spring fastening frame 15, and a fourth elastic cylindrical pin 16.

A connection relationship of the retrieving mechanism 35 is: a bottom end of the steel rope 33 passes through the radial through-hole of the retrieving cylinder 39 and is fastened, the hook 32 at a bottom end of the retrieving cylinder 39 opens or closes for being connected to or separated from the retrieving spear head 2 on the retrieving head set 40.

A connection relationship of the retrieving cylinder 39 is: the hook 32 is loaded into the separating cylinder 31 through a spring. A connection relationship of the retrieving head set 40 is: firstly, the second spring 3 is placed in the spring holder 4 for being loaded into the retrieving spear head 2 together with the spring holder 4, the retrieving spear head 2 is connected to the retrieving spear holder 5 through the first elastic cylindrical pin 6, the top sliding bush 8 is connected to the retrieving spear holder 5 through the second elastic cylindrical pin 7; secondly, the spring fastening holder 14 is connected to the spring fastening frame 15 through the cylindrical pin 13, the two spring fastening calipers 10 are connected to the spring fastening frame 15 through the third elastic cylindrical pin 12, the two spring fastening calipers 10 are respectively connected to two ends of the tension spring 9, the retrieving tube 11 is connected to the spring fastening frame 15 through the fourth elastic cylindrical pin 16; and finally, a top end of the retrieving tube 11 is connected to a bottom end of the top sliding bush 8 through a screw thread, the steel rope 33 hangs on the separating cylinder 31.

The power mechanism 37 comprises a flat thrust bearing 17, a screw stator 18, a screw rotor 19, a limiting piston 20, and a first spring 21, wherein a connection relationship of the power mechanism 37 is: firstly, the flat thrust bearing 17 is placed at a top platform of the screw rotor 19 and is pushed forwards for being axially mounted, and the screw rotor 19 is placed in the screw stator 18; secondly, a first end of the first spring 21 is welded on the limiting piston 20; and finally, a second end of the first spring 21 is placed at an inner platform surface of the limiting connector 22 by gravity.

The coring mechanism 38 comprises a coring cylinder 25, a core grabber 26, and a coring bit 27, wherein a connection relationship of the coring mechanism 38 is: the core grabber 26 cooperates with an inner conical surface of the coring bit 27, and then the coring cylinder 25 is connected to the coring bit 27 through a screw thread.

Operation of the WD sidewall coring tool is as follows. The outer cylinder set 40 is pre-installed between the drill collar and the overall drilling bit. For overall drilling, the retrieving head set 40 and the drilling sealer mechanism 36 are put into the outer cylinder set 34 by the steel rope 33 and the retrieving cylinder 39. The sealing plug 30 blocks the coring window of the turning connector 23. Drilling fluid circulates through the turning connector 23 for providing normal overall drilling. For coring, the overall drilling is stopped, as well as a pump. The drilling sealer mechanism 36 is pulled out by the steel rope 33 and the retrieving mechanism 35. Then the inner structure for coring is placed in the outer cylinder 34 by the steel rope 33 and the retrieving cylinder 39. Then the pump is started, and a hydraulic screw motor generates a rotary power for drilling. Meanwhile, the coring mechanism 38 is pressed downwards by the drilling fluid. The coring bit 27 extends out through the coring window for rotary coring and drilling. Finally, the core obtained is lifted by the retrieving mechanism 35 for finishing coring.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A WD sidewall coring tool, comprising:

an outer cylinder set (34);

a retrieving mechanism (35);

a drilling sealer mechanism (36);

a power mechanism (37); and a coring mechanism (38);

wherein said outer cylinder set (34) comprises a stabilizer (1), a limiting connector (22), and a turning connector (23) connected in sequence;

wherein said retrieving mechanism (35) comprises a retrieving cylinder (39), a retrieving head set (40), and a steel rope (33), wherein said steel rope (33) is connected to a radial through-hole of said retrieving cylinder (39), said retrieving cylinder (39) is connected to said retrieving head set (40);

wherein said drilling sealer mechanism (36) comprises a connecting rod (28), a universal joint (24), a plug sleeve (29), and a sealing plug (30), wherein said retrieving head set (40) is connected to said connecting rod (28); said connecting rod (28), said universal joint (24), said plug sleeve (29), and said sealing plug (30) are connected in sequence;

wherein said power mechanism (37) comprises a flat thrust bearing (17), a screw stator (18), a screw rotor (19), a limiting piston (20), and a first spring (21), wherein said flat thrust bearing (17) is axially mounted on said screw rotor (19), said screw rotor (19) cooperates with said screw stator (18), a first end of said first spring (21) is mounted on said limiting piston (20), a second end of said first spring (21) cooperates with said limiting connector (22); and wherein said coring mechanism (38) comprises a coring cylinder (25), a core grabber (26), and a coring bit (27), wherein said core grabber (26) cooperates with an inner conical surface of said coring bit (27), said coring cylinder (25) is connected to said coring bit (27).

2. The WD sidewall coring tool, as recited in claim 1, wherein during overall drilling, in said WD sidewall coring tool, a bottom end of said retrieving head set (40) is connected to said connecting rod (28) through a screw thread, a bottom end of said connecting rod (28) is connected to said plug sleeve (29) through a screw thread, a bottom end of said plug sleeve (29) is connected to said sealing plug (30) through a screw thread, which are placed in an inner cylinder set during overall drilling, said sealing plug (30) blocks a coring window of said turning connector (23).

3. The WD sidewall coring tool, as recited in claim 2, wherein during coring, in said WD sidewall coring tool, a bottom end of said steel rope (33) is connected to said retrieving head set (40), said bottom end of said retrieving head set (40) is connected to said power mechanism (37) through a screw thread, a bottom end of said power mechanism (37) is connected to said universal joint (24) through a flange bolt, a bottom end of said universal joint (24) is connected to said coring mechanism (38) through a flange bolt, which are placed in said inner cylinder set during coring.

4. The WD sidewall coring tool, as recited in claim 1, wherein during coring, in said WD sidewall coring tool, a bottom end of said steel rope (33) is connected to said retrieving head set (40), a bottom end of said retrieving head set (40) is connected to said power mechanism (37) through a screw thread, a bottom end of said power mechanism (37) is connected to said universal joint (24) through a flange bolt, a bottom end of said universal joint (24) is connected to said coring mechanism (38) through a flange bolt, which are placed in an inner cylinder set during coring.

5. The WD sidewall coring tool, as recited in claim 1, wherein said outer cylinder set (34) is pre-installed between a drill collar and an overall drilling bit; a top-to-bottom connection relationship thereof is: a bottom end of the drill collar is connected to said stabilizer (1) through a screw thread, a bottom end of said stabilizer (1) is connected to said limiting connector (22) through a screw thread, a bottom end of said limiting connector (22) is connected to said turning connector (23) through a screw thread, a bottom end of said turning connector (23) is connected to the overall drilling bit through a screw thread.

6. The WD sidewall coring tool, as recited in claim 1, wherein said retrieving cylinder (39) comprises a separating cylinder (31) and a hook (32), said hook (32) is loaded into said separating cylinder (31) through a spring.

7. The WD sidewall coring tool, as recited in claim 6, wherein said retrieving head set (40) comprises a retrieving spear head (2), a second spring (3), a spring holder (4), a retrieving spear holder (5), a first elastic cylindrical pin (6), a second elastic cylindrical pin (7), a top sliding bush (8), a tension spring (9), two spring fastening calipers (10), a retrieving tube (11), a third elastic cylindrical pin (12), a cylindrical pin (13), a spring fastening holder (14), a spring fastening frame (15), and a fourth elastic cylindrical pin (16); a connection relationship of said retrieving head set (40) is: firstly, said second spring (3) is placed in said spring holder (4) for being loaded into said retrieving spear head together with said spring holder (4), said retrieving spear head (2) is connected to said retrieving spear holder (5) through said first elastic cylindrical pin (6), said top sliding bush (8) is connected to said retrieving spear holder (5) through said second elastic cylindrical pin (7); secondly, said spring fastening holder (14) is connected to said spring fastening frame (15) through said cylindrical pin (13), said two spring fastening calipers (10) are connected to said spring fastening frame (15) through said third elastic cylindrical pin (12), said two spring fastening calipers (10) are respectively connected to two ends of said tension spring (9), said retrieving tube (11) is connected to said spring fastening frame (15) through said fourth elastic cylindrical pin (16); and finally, a top end of said retrieving tube (11) is connected to a bottom end of said top sliding bush (8) through a screw thread, said steel rope (33) hangs on said separating cylinder (31).

8. The WD sidewall coring tool, as recited in claim 1, wherein a connection relationship of said retrieving mechanism (35) is: a bottom end of said steel rope (33) passes through said radial through-hole of said retrieving cylinder (39) and is fastened, said hook (32) at a bottom end of said retrieving cylinder (39) opens or closes for being connected to or separated from said retrieving spear head (2) on said retrieving head set (40).

9. The WD sidewall coring tool, as recited in claim 1, wherein a connection relationship of said drilling sealer mechanism (36) is: firstly, said spring fastening frame (15) on said retrieving head set (40) is connected to said connecting rod (28) through a screw thread; secondly, said connecting rod (28) is connected to said universal joint (24) through a flange bolt, said universal joint (24) is connected to said plug sleeve (29) through a flange bolt; and finally, said plug sleeve (29) is connected to said sealing plug (30) through a screw thread.

10. The WD sidewall coring tool, as recited in claim 1, wherein a connection relationship of said power mechanism (37) is: firstly, said flat thrust bearing (17) is placed at a top platform of said screw rotor (19) and is pushed forwards for being axially mounted, and said screw rotor (19) is placed in said screw stator (18); secondly, said first end of said first spring (21) is welded on said limiting piston (20); and finally, said second end of said first spring (21) is placed at an inner platform surface of said limiting connector (22) by gravity.

11. The WD sidewall coring tool, as recited in claim 1, wherein a connection relationship of said coring mechanism is: said core grabber (26) cooperates with said inner conical surface of said coring bit (27), and then said coring cylinder (25) is connected to said coring bit (27) through a screw thread.

* * * * *